US005864887A

United States Patent [19]

Kozawa

[11] Patent Number: 5,864,887

[45] Date of Patent: Feb. 2, 1999

[54] PROTECTIVE COVER FROM COSMETIC DIRT

[76] Inventor: Keiko Kozawa, 327-1 Yasuji-cho, Nishi-ku, Nagoya 452-0815, Japan

[21] Appl. No.: 61,721

[22] Filed: Apr. 17, 1998

[51] Int. Cl.[6] ..... A42B 1/04

[52] U.S. Cl. ..... 2/174; 2/202; 2/209.13

[58] Field of Search ..... 2/171, 174, 175.7, 2/202, 209.13, 204, 205

[56] References Cited

U.S. PATENT DOCUMENTS

| | | | |
|---|---|---|---|
| 971,476 | 9/1910 | Rostenberg | 2/204 |
| 1,345,547 | 7/1920 | McDonald | 2/175.7 |
| 4,698,853 | 10/1987 | Walton | 2/174 |

*Primary Examiner*—Diana L. Biefeld

[57] ABSTRACT

A cover to protect the clothing from cosmetic dirt is disclosed. In order to realize the protection, the cover comprises an upper part that covers the head, a lower part that covers around the neck, an elastic part in between, and a loopy strap on the top. As the cover is placed between the head and the neckline of clothing, the clothing does not touch the cosmetics on the face, when being dressed or undressed. As a result, the clothing is completely protected from cosmetic dirt, while the cover can be quickly and easily put on and off.

Additionally, a pair of releasable fasteners attached to a loopy strap on the top, or a loopy strap and the main body of cover make the cover in a compact manner for easy carrying.

4 Claims, 5 Drawing Sheets

(A)

(B)

PROTECTIVE COVER FROM COSMETIC DIRT

BACKGROUND OF THE INVENTION

This invention relates to a cover to protect clothing, such as pullovers, from cosmetic dirt, when the clothing is dressed or undressed, and relates to configurations to make the cover portable.

For those who do makeup their faces with cosmetics, pullover-type wear, especially around the neckline, easily get dirt off cosmetics, such as foundation and rouge, when dressing or undressing. It is felt unpleasant and unclean, if the clothing gets any of the dirt. Formerly, in order to protect from the dirt, they have widen the neckline of the clothing with excessive force, or have used a piece of cloth, such as a scarf or a towel to cover the head. However, these means cannot protect the clothing from the dirt successfully. The neckline of the clothing may become too loose with excessive force. A piece of cloth may be so unstable that the head cannot be covered up properly.

BRIEF SUMMARY OF THE INVENTION

This invention presents a protective cover from cosmetic dirt. The invented cover comprises an upper part in which one's head is placed, a lower part that covers around the neck, an elastic part between the upper and lower parts, and a loopy strap on the top for hanging. Additionally, this invention presents configurations of the strap supplied on the top to make the cover portable.

BRIEF DESCRIPTION OF THE DRAWINGS

To assist with understanding the invention, reference will now be made to the accompanying drawings which show four examples of the invention.

FIG. 2 (A) is a squint drawing, and

FIG. 2 (B) a vertical section drawing.

DETAILED DESCRIPTION OF THE INVENTION

Figure 1:
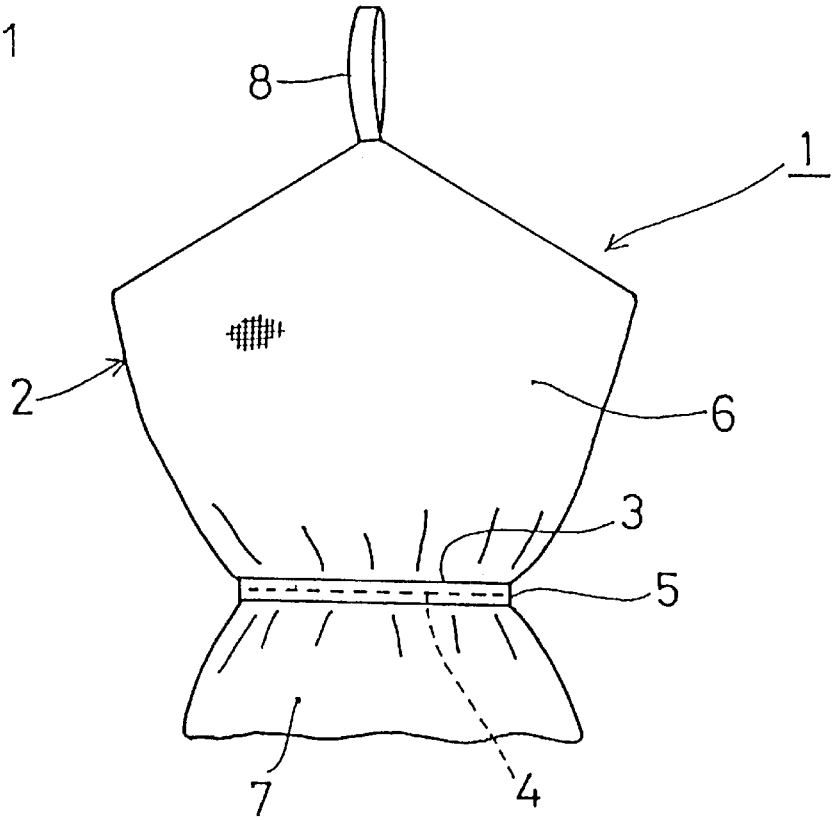
FIG. 1 is a ground plan drawing of the $1^{st}$ example of the invented protective cover.

The objective of the present invention is to provide a protective cover that overcomes problems said in background. In addition, the invention has another objective, that is to provide a protective cover that can be made compact for easy carrying.

As the $1^{st}$ example, a practical manner of the invention is explained with the drawings, FIG. 1 to FIG. 7. In FIG. 1 to FIG. 4, 1 is a protective cover, "the cover" afterward, with a downward opening. 2 is the main body of the cover. The material for 2 may be chosen from a various types of fabric, but some smooth and transparent fabric, such as organdy and chiffon are suitable, as the cover may move smoothly, the outside is visible, and it is not stifling. In the lower part of 2, a cloth tape 3 is stitched to make a tunnel in which an elastic string 4 is let through. 2, 3 and 4 make up the elastic part 5. 6 is the upper part where one's head is inserted and placed, and 7 is the lower part that covers around the neck. On the top of 2, a loopy strap 8 is supplied for hanging the cover. To supply the loopy strap, materials like a ribbon, string or a cord may be used.

Figure 2:
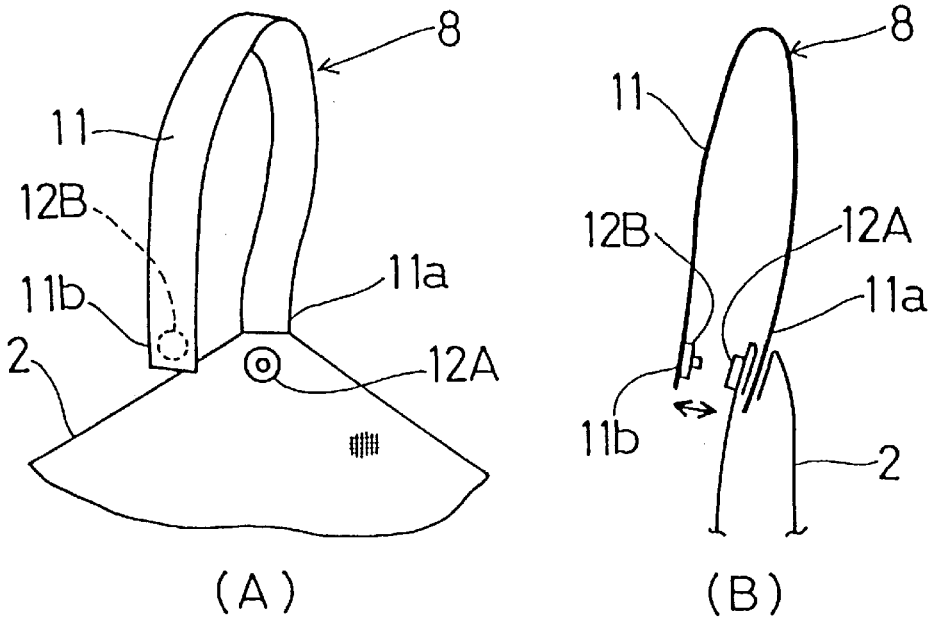
FIG. 2 is a detailed drawing of a strap part for claim 2.

The strap can be in an ideal form that one end of the strap is fixed to the body of the cover, while the other end with a fastener is attached or detached to the body with a counterpart fastener as in claim 2, or the other end with a fastener attached and detached to the strap as in claim 3. As shown in FIG. 2, 8 comprises a body 11, one end 11*a* fixed to the body, and the other end 11*b* with a snap fastener 12B, while the counterpart fastener 12A is fixed on the body of the cover or the strap to make the other end releasable.

With regard to FIG. 2(B) cross section, seamed parts are drawn with some space for better understanding. Some following drawings have also some space for the same reason.

Figure 3:
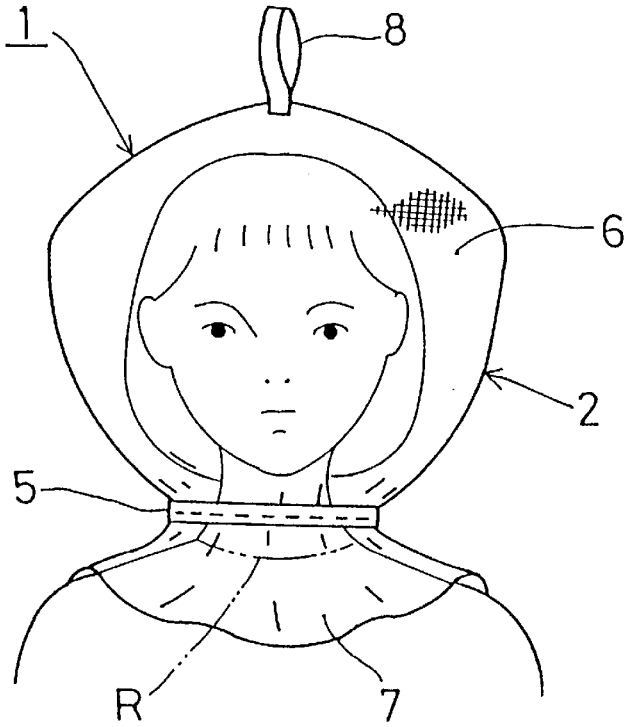
FIG. 3 is a front drawing of the invented cover in use.
Figure 4:
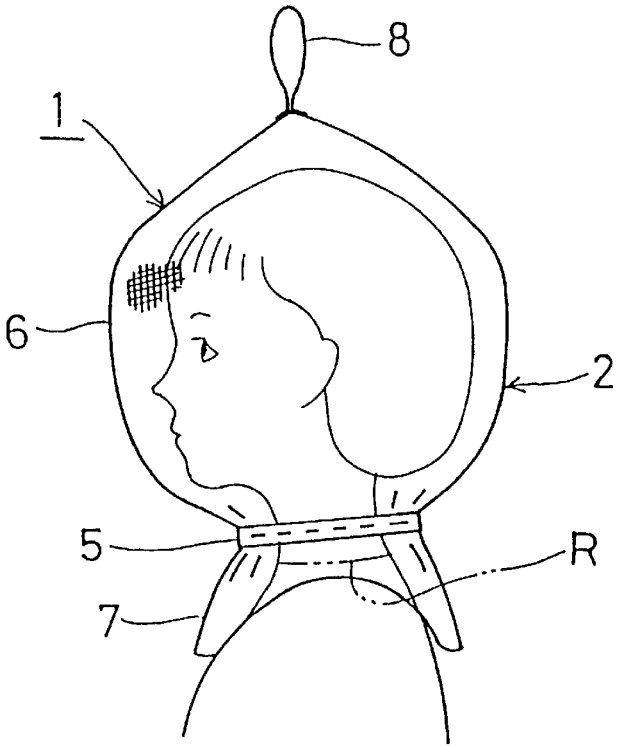
FIG. 4 is a side drawing of the invented cover in use.

An example use of the cover 1 is explained. One should put the hands from the opening of 7, widen 5 so that 4 expands, insert and place one's head in 6, and remove the hands so that 4 contracts. FIG. 3 and FIG. 4 show that 1 is in fit. The comfortable elasticity of 5 can be achieved by adjusting the length of 4. Basically there can be some space between 5 and the neck. Even if there is some space, it is fit for comfortable use without pressure. In this manner of FIG. 3 and FIG. 4, one should put on a pullover, while 2 covers one's face completely so that the makeup does not come off to the pullover at all. After the pullover is put on, one may widen 5 and take it off upward. As said, the handling is very easy.

When one puts off a pullover, 1 is put on the head in the same manner as mentioned above, then the lower part 7 is put underneath the neckline of pullover with a hand(s), and the pullover is turned over and pulled upward to put it off. As the neckline R of the pullover passes the outer of 2, it does not get any cosmetic dirt. One may put off the pullover first, then the cover, or put off both at once. In either case, the neckline R is protected with 1, as it does not touch the face with makeup for 1 in between. If one is in hurry when a pullover is put off, both the front and back of 7 do not have to be put underneath the neckline R, but only the front part.

Figure 5:
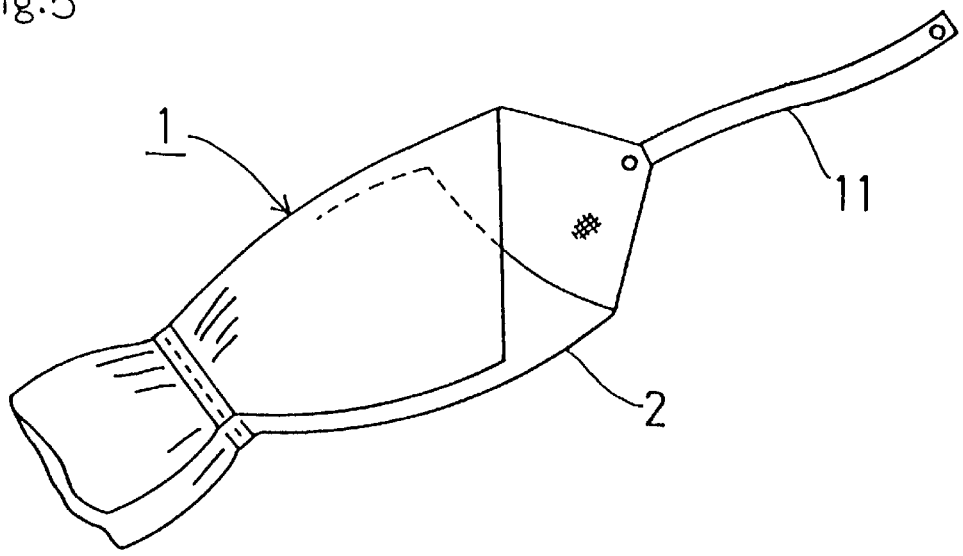
FIG. 5 is a squint drawing of the invented cover in process of being folded.
Figure 6:
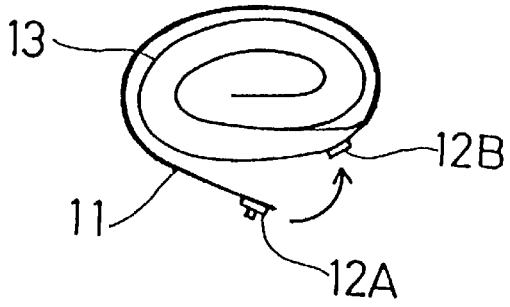
FIG. 6 is a side drawing of the invented cover folded up.
Figure 7:
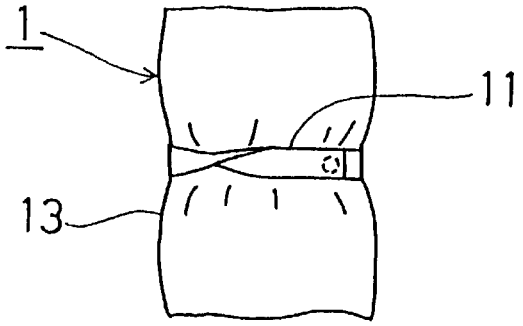
FIG. 7 is a ground plan drawing of the invented cover tied up.

After the use of 1, it can be hung on a peg or something by using 8. If 1 is provided with the invention of claim 2 or claim 3, it can be folded as shown in FIG. 5, 12A and 12B detached, 1 folded or rolled up to make it like 13, tied up 13 with 11, and 12A and 12B attached, as shown in FIG. 6. FIG. 7 shows a compact manner that is ideal for carrying.

Figure 8:
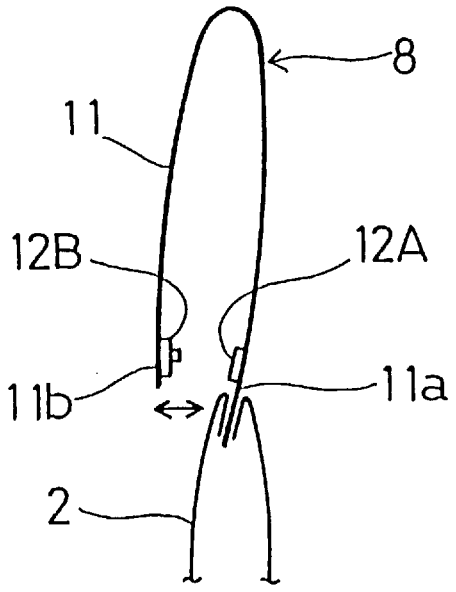
FIG. 8 is a corresponding drawing to FIG. 2(B) for the $2^{nd}$ example.

FIG. 8 shows the $2^{nd}$ example. For FIG. 8, the snap fastener 12A is fixed around 11*a*, while the other compositions are same as the $1^{st}$ example, and the way of use and functions are also same as the $1^{st}$ example. Thus, same signs for same parts or corresponding parts are used, and detailed explanation is omitted. The following examples are described in the same way.

Figure 9:
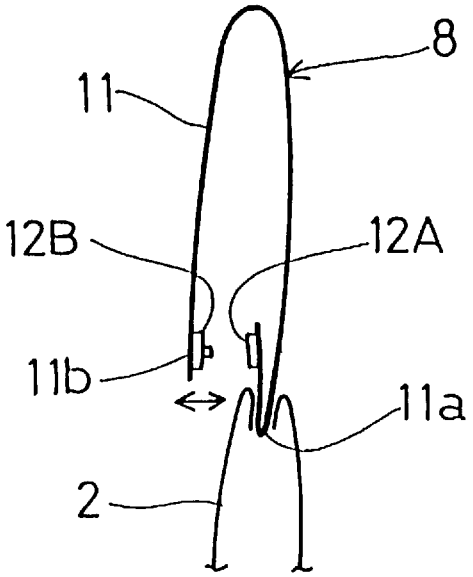
FIG. 9 is a corresponding drawing to FIG. 2(B) for the $3^{rd}$ example.

FIG. 9 shows the $3^{rd}$ example. One end of 11 is folded back, the folded part is stitched with 2, and 12A is fixed to the projecting end.

Figure 10:
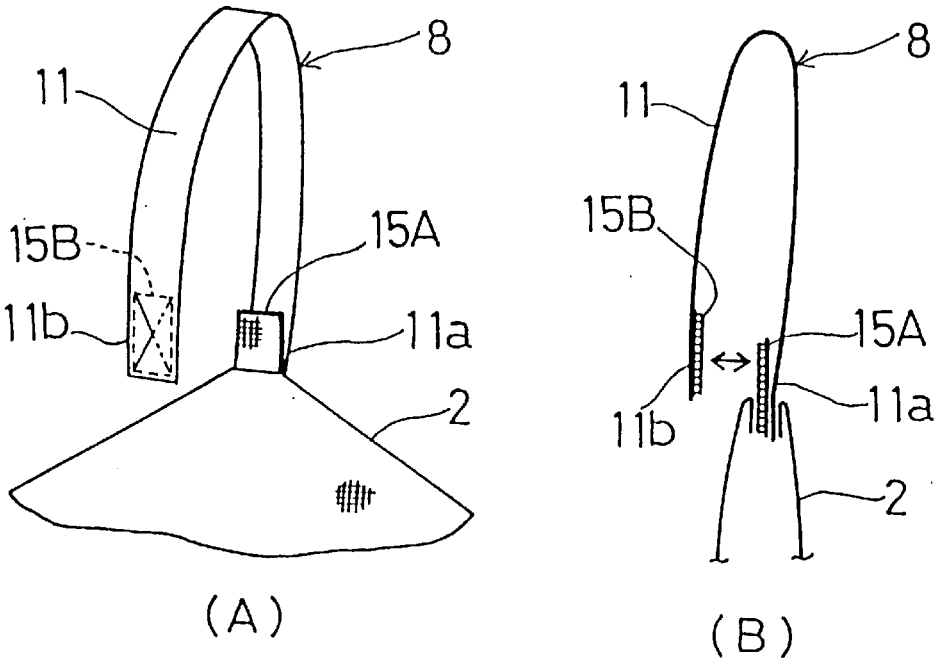
FIG. 10 is a corresponding drawing to FIG. 2(B) for the $4^{th}$ example.

FIG. 10 shows the $4^{th}$ example. As a pair of fasteners, adjustable strap, such as Velcro® closures, 15A and 15B are used. The base part of 15A and the base part of 11, 11*a* can be stitched with 2, while 15B is fixed on the other end of 11, 11*b*.

Figure 11:
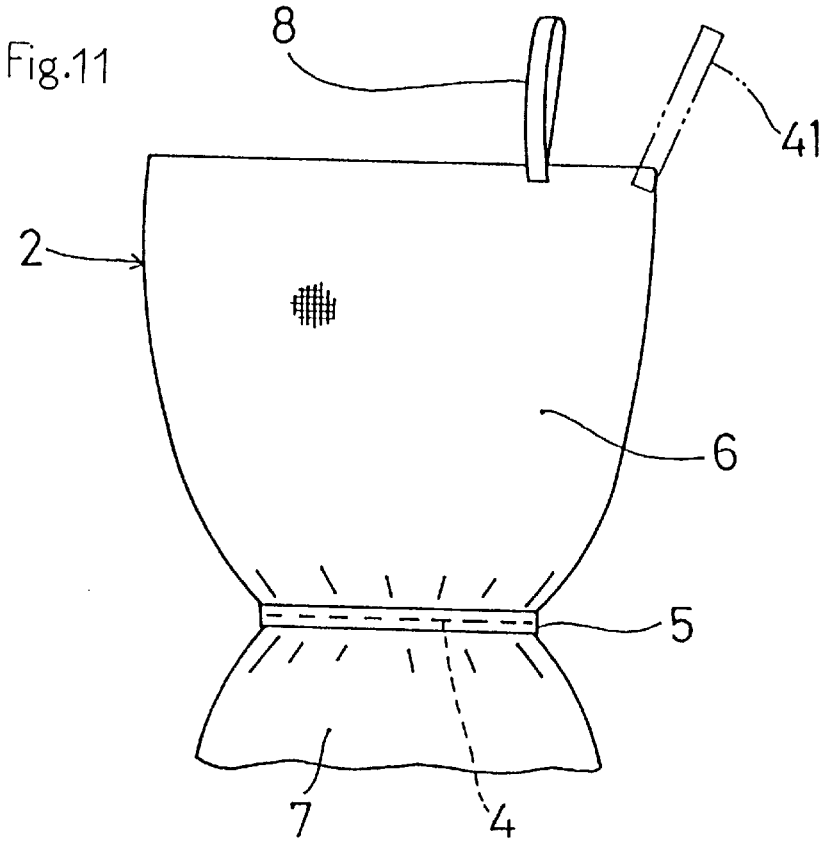
FIG. 11 is a grand plan drawing of the invented cover with a hanging strap in other possible positions.

This invention is not limited to the previously mentioned means, and other materials and forms can be applied without departing from the scope of the invention. For example, a strap 8 or 41 for hanging can be placed as shown in FIG. 11. In order to make part 5 elastic, besides elastic string 4 as mentioned previously, shirring can also be applied by a sewing machine using elastic strings or shirring tapes. In addition, as fasteners, other kinds such as buttons, hooks and eyes, and clips also can be used, besides snap fasteners and adjustable straps.

What is claimed is:

1. A protective cover to protect clothing from cosmetic dirt made of fabric and comprising an upper part where a wearers head may be located, a lower part with a downward opening for covering around a wearers neck, an elastic part to gather the lower part around the wearers neck, and a strap having one end secured to said protective cover, and having a releasable fastener at another end for forming a loop, said loop enabling hanging up of said protective cover and enabling securing said protective cover in a folded or rolled up configuration for compact stowage.

2. The protective cover of claim 1 wherein said releasable fastener fastens to the protective cover to form said loop.

3. The protective cover of claim 1 wherein said releasable fastener fastens to said strap to form said loop.

4. The protective cover of claim I wherein said lower part extends below the downward opening for covering around the wearers neck and over the top of the wearers shoulders.

* * * * *